US005201851A

United States Patent [19]

Holmström

[11] Patent Number: 5,201,851

[45] Date of Patent: Apr. 13, 1993

[54] PUMP AND METERING APPARATUS

[75] Inventor: Torbjörn Holmström, Upsala, Sweden

[73] Assignee: Pharacia Biosensor AB, Upsala, Sweden

[21] Appl. No.: 768,514

[22] PCT Filed: Apr. 17, 1990

[86] PCT No.: PCT/SE90/00259

§ 371 Date: Sep. 26, 1991

§ 102(e) Date: Sep. 26, 1991

[87] PCT Pub. No.: WO90/12960

PCT Pub. Date: Nov. 1, 1990

[30] Foreign Application Priority Data

Apr. 18, 1989 [SE] Sweden ..... 8901399

[51] Int. Cl.[5] ..... F04B 35/00; F04B 13/00; F16H 29/20

[52] U.S. Cl. ..... 417/415; 74/89.15

[58] Field of Search ..... 417/415; 74/89.15

[56] References Cited

FOREIGN PATENT DOCUMENTS 1480010 2/1975 United Kingdom .

*Primary Examiner*—Richard A. Bertsch
*Assistant Examiner*—Roland McAndrews
*Attorney, Agent, or Firm*—Birch, Stewart, Kolasch & Birch

[57] ABSTRACT

A pump and metering apparatus includes a frame supporting a liquid container with a movable plunger therein for discharging respectively liquid which is drawn therein. A plunger is connected to a runner member, connected by a nut portion thereof which threadedly engages a screw rotatably mounted in the frame and coupled to a driving motor. According to the invention the nut portion of the runner member is movable in relation to the remaining structure of the runner member in the radial direction of the screw, such that the nut portion will be self-centering on the center axis of the screw.

17 Claims, 3 Drawing Sheets

PUMP AND METERING APPARATUS

BACKGROUND OF THE INVENTION

1. Field of the Invention

The present invention relates to a pump and metering apparatus having improved flow stability.

2. Description of Background Art

For certain analytical techniques, e.g. within medical research, access to pumps capable of low, stable flows is required. A conventional type of such a pump basically consists of a syringe and a means for actuating the syringe plunger. The latter device usually comprises a rotatably mounted screw, along which a runner engaging the screw and actuating the syringe plunger is moved by rotating the screw through either a stepping motor or a DC motor and a gear-wheel transmission. Factors which directly will influence the precision and flow stability of such a pump device are backlashes and wobbles in gear-wheel transmissions, slip-stick phenomenons of the syringe plunger, temporary absorption of energy in connections between driving motor and screw, and elongations of the pump chassis. While the flow stability achievable by such a pump device is completely sufficient for many purposes, there has recently, e.g. in biosensor technology, arisen a need for pump devices having improved flow stability performance.

While several of the above enumerated disturbing factors may be reduced or eliminated relatively easily, e.g. by replacing a DC motor and necessary transmission with a stepping motor and/or avoiding elastic couplings for eliminating slip-sticks, it was found to be more difficult to overcome the disturbances in the form of flow ripple caused by wobbles of the screw, either due to it not being completely straight or not being completely aligned with the motor axis. Such wobbles cause the runner threads to travel up and down on the thread flank of the screw, and also very small wobbles have been found to give unacceptable flow disturbances in cases where the requirements of flow stability are high.

It is known to use so-called ball screws to avoid travelling on the screw thread flank. Such ball screws are, however, relatively expensive, and the biasing of the balls must also be continuously adjusted in accordance with the wearing of the balls for them to contact the thread flank all the time.

SUMMARY AND OBJECTS OF THE INVENTION

The object of the present invention is to provide an improved pump and metering apparatus, in which the above mentioned problem of flow instability due to wobbles of the screw has been eliminated and which may thus be made to fulfil very high requirements concerning flow stability.

According to the invention this is achieved by a pump and metering apparatus, which supported in a chassis or frame has a liquid container with a movable plunger therein, by means, of which liquid may be pressed out from or drawn into the container. The plunger is connected to a runner means which through a nut portion thereof is in thread engagement with a screw rotatably mounted in the frame and connected to a driving motor. The rotation of the screw caused by the driving motor brings about a longitudinal movement of the runner and thereby a corresponding displacement of the plunger in the container. The invention is characterized in that the above mentioned nut portion is arranged to be movable in the radial direction of the screw relatively to the remaining runner structure. Hereby self-centering of the runner means nut portion on the centre axis of the screw is achieved, whereby all tendencies to travelling on the thread flank of the screw, e.g. due to a not completely straight screw or the screw being inclined in relation to the motor axis, are eliminated such that excellent flow stability is achieved.

In the present context radial movability means movability in all radial directions with respect to the screw axis. Such radial movability of the nut portion of the runner means, simultaneously with rigidity in the axial direction of the screw, may be achieved in various ways within the scope of the invention; the term nut portion is herein to be understood in a wide sense and may also constitute the major part of or substantially the whole runner means.

According to one embodiment radially overlapping portions of a separate nut and a separate runner member are slidably biased against each other, e.g. by a spring bias. The overlapping portions are preferably connected to each other by means of rigid axial connecting means extending from one of the nut and the runner into axial bores of the other, the radial movability of the connection being ensured on one hand by these bores having a larger diameter than the connecting means and on the other hand by the biasing permitting a slight but sufficient axial movability between the nut and the runner to allow relative sliding.

According to another embodiment the nut portion is radially movably attached to the runner through at least one radially extending rigid connecting means, such as a pin(s), flange means on the runner or nut, or the like. These connecting means may either be fixedly arranged on one of the runner and the nut portion and extend into one or more radial recesses of the other, or be separate means extending into radial recesses in both the runner and the nut portion, the recesses in both cases having sufficient dimensions in the radial direction to permit the desired radial movability of the nut in relation to the runner.

According to still another embodiment, the nut is connected to the runner through a portion of a material which is elastic in the radial direction of the screw but at least substantially non-elastic in the axial direction of the screw. Alternatively, a conventional elastic material may be used if guide means are provided which prevent relative movability in the axial direction.

For the advantages of the self-centering of the runner on the screw accomplished in accordance with the invention to be utilized in their full extension, the connection between the driving motor and the screw should be rigid. Otherwise, as mentioned previously, energy will be absorbed, which may give rise to disturbances when it is released.

Further, in cases where very small flows are required, it is preferred to use a stepping motor, the risk of flow disturbances due to backlashes in the gear box necessary for a DC motor hereby being eliminated.

According to a preferred embodiment of the invention the nut portion of the runner is of the backlash-free nut type. A standard type of such a nut consists of two halves, which by means of an intermediate rigid or elastic spacer member is biased against the thread flanks of the screw.

BRIEF DESCRIPTION OF THE DRAWINGS

Hereinafter the invention will be described in more detail with regard to some preferred embodiments, reference being made to the accompanying drawings, in which.

DETAILED DESCRIPTION OF THE PREFERRED EMBODIMENTS

Figure 1:
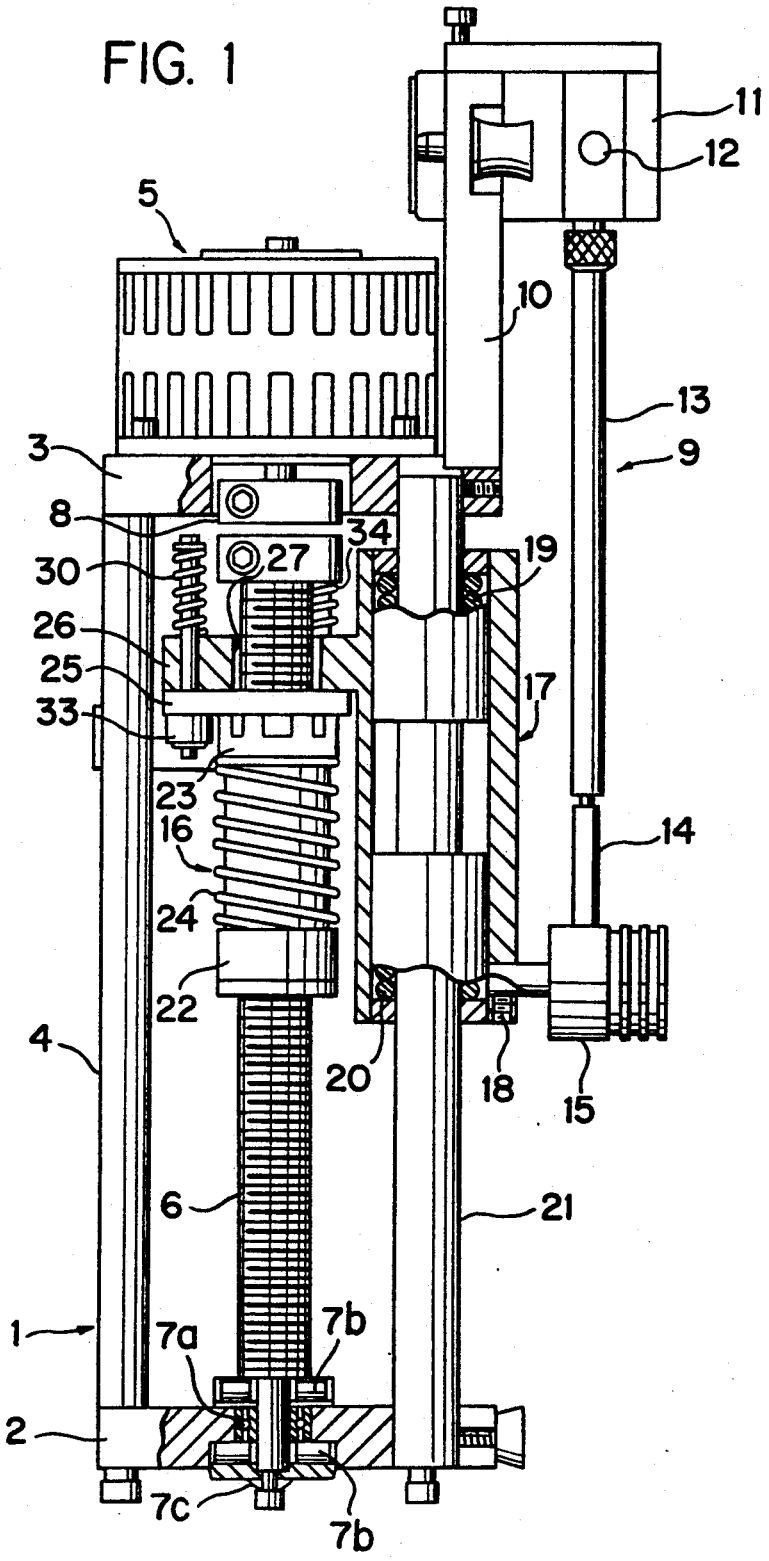
FIG. 1 is an elevational view, partially in section and with portions cut away, of an embodiment of a pump and metering apparatus according to the invention.

The pump and metering apparatus illustrated in FIG. 1 has a frame 1, consisting of a bottom plate 2 and a top plate 3 connected through three vertical supporting rods 4 (only one of which is shown). In the upper part 3 of the frame a driving motor 5, here a stepping motor, for driving a vertical screw 6 is supported. The screw 6 is rotatably mounted in the bottom plate 2 through a ball bearing 7*a* and two axial roller bearings 7*b* and rigidly connected to the drive shaft of the motor 5 through coupling means 8. The two roller bearings 7*b* are axially biased towards each other by a cup spring 7*c*, thereby eliminating gaps in the ball bearing.

A piston pump device 9 is supported in the upper part of the frame 1 through a bracket 10. The piston pump device 9 consists of a connecting block 11 having an outlet/inlet opening 12, to which the open end of a syringe cylinder 13 can be fixed to communicate with the opening 12. In the syringe cylinder 13 a syringe piston (not shown) is displaceably mounted and connected to a piston rod 14 rotatably and removably mounted in an actuating member 15. The syringe assembly 13, 14 may thus easily be removed from the apparatus.

The rotational movement of the screw 6 caused by the driving motor 5 is transmitted to the actuating member 15 through a transmission means consisting of a nut 16 engaging the screw 6 and a runner 17 connected to the nut 16, the actuating member 15 of the piston rod being fixed to the lower part of the runner by a screw 18. The runner 17 is via ball bushings 19, 20 slidably mounted on a vertical rod 21 extending between the top and bottom plates 2, 3 of the frame and guiding the runner 17 linearly to prevent rotation thereof.

The nut 16 is of the backlash-free type and consists of a lower half 22 and an upper half 23, which halves are mutually biased apart by a spring 24, such that the respective nut half is pressed against the thread flank of the screw 6 and backlashes thereby are eliminated. The top part of the backlash-free nut 16 is a planar triangular portion 25, the corners of which in a flange-like manner project past the side of the nut body and to which an overlying flange portion 26 of the runner 17 having a central recess 27 for the screw 6 is attached by special bolt joints in such manner that the nut 16 is movable in the radial direction in relation to the runner 17. This movable attachment of the nut 16 to the runner 17 is shown in more detail in FIGS. 2 and 3.

Figure 2:
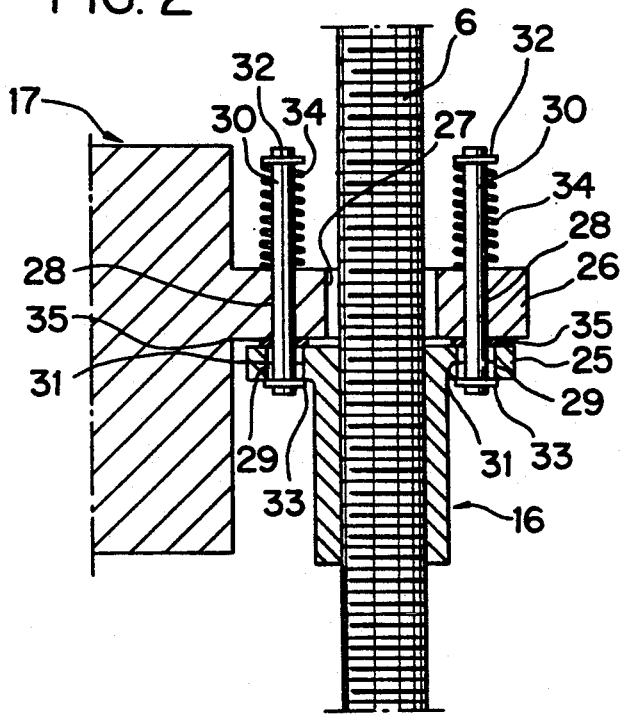
FIG. 2 is a simplified partial sectional view of the radially movable connection between nut portion and plunger supporting part of the runner means in FIG. 1.
Figure 3:
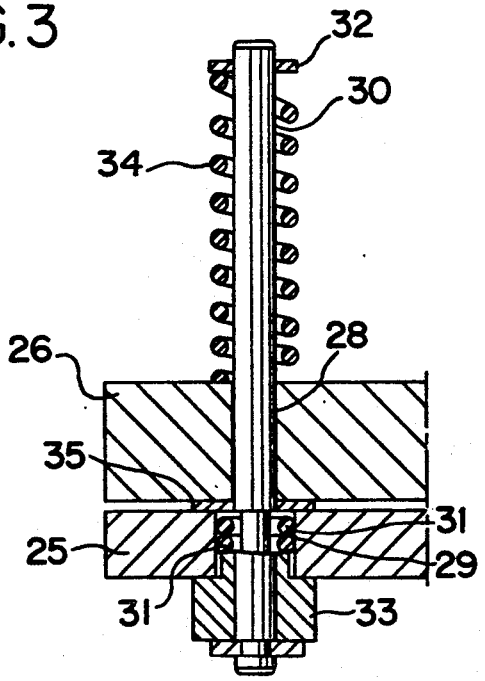
FIG. 3 is an enlarged view of a part of the radially movable nut/runner connection in FIG. 1.

While FIG. 2 illustrates the basic concept of movable nut/runner attachment used in the FIG. 1 embodiment, it does not exactly conform with the latter in the detailed design thereof. FIG. 3, on the other hand, is an enlarged view of a part of the movable attachment of the embodiment in FIG. 1.

As appears from FIGS. 2 and 3 the flange portion 26 of the runner 17 and the upper part 25 of the nut 16 have aligned bores 28 and 29, respectively, through which three axially movable rod members 30 run (in FIG. 2 only two such rod members 30 are shown), the bores 29 being arranged in the projecting corners of the nut fastening plate 25 and being a little larger than the rod diameter such that the nut 16 will obtain radial movability in relation to the rod members. The radial movement is restricted by elastic members 31, e.g. o-rings (two in FIG. 3), mounted in the interspace between the rod members 30 and the fastening bores 29. The rod members 30 are in both ends thereof provided with upper and lower stopping means 32 and 33, respectively, e.g. stopping washers or the like. While the lower stopping means 33 contact the underside of the fastening plate 25, resilient members 34, such as screw springs, are provided between the upper stopping means 32 and the runner 17. By the spring bias, the nut 16 will all the time press axially against the flange portion 26 of the runner simultaneously as it may slide radially.

To ensure such sliding between flange portion 26 and nut part 25 a low friction material washer 35 (e.g. of Teflon (®)) is inserted therebetween. For the same reason the members 33 in FIGS. 2 and 3 are made of a low friction material (e.g. POM [polyoxymethylene]). The spring bias is adapted to permit sliding but prevent separation of the contacting surfaces when drawing in liquid.

By virtue of this radial movability the nut 16 will all the time be centered on the centre axis of the screw 6. Hereby it is avoided that the centers of the nut and the screw are displaced in relation to each other when the screw wobbles, e.g. due to a not complete linearity of the screw, which displacement would cause the nut to travel up and down on the thread flank. It may be noted that even such small wobbles as 5/100 mm in the absence of this self-centering may cause unacceptable disturbances of the pump flow.

When using the pump and metering apparatus illustrated in the drawings the stepping motor 5 is microstepped for driving the screw 6. Due to the rigid direct coupling between screw and driving motor shaft an exact transmission of the rotation is obtained, whereby the risk of elongations and absorbed energy with consequential slip-stick phenomenons is eliminated. The screw 6 transmits its rotation to a vertical movement of the runner 17 via the backlash-free nut 16. This movement is transmitted by the runner to the syringe plunger in the syringe cylinder 13. As mentioned above, the self-centering on the centre axis of the screw obtained by the radial movability of the nut 16 brings about freedom from travelling on the thread flank when the screw 6 wobbles, the movement of the syringe plunger being very stable and a flow from the opening 12 substantially free from flow instabilities being obtained even for extremely low flows. Thus, with the illustrated apparatus having, for example, a syringe volume of 500 μl, flows varying between 1 and $10^5$ μl/min with extraordinary stability and precision may be obtained, and the pump and metering apparatus is therefore well suited for applications with highly put requirements as to flow stability, such as in biosensor technology and the like.

In the illustrated construction the o-rings 31 in the fastening bores 29 of the nut 16 are not necessary for a disturbance-free travel movement to be obtained, but the o-rings 31 minimize the turning spring obtained in the suction/discharge change-over when the pump is used as a metering unit.

In the pump and metering apparatus shown in the drawings, the biasing of the nut 16 and the runner 17 obtained by the springs 34 may instead be accomplished by draw springs acting between the runner 17 and the bottom plate 2 of the frame. In this case, however, the biasing will vary with the position of the runner along the screw. Further, the nut 16 may alternatively be fixed to the top of the runner 17 instead of to the underside as in FIGS. 1 and 2. The spring members 34 may alternatively be mounted between the lower stopping means 33 and the nut top part 25. In this case the rod members 30 may be fixedly arranged in the flange portion 26 of the runner.

FIGS. 4-7 illustrate alternative embodiments of the radially movable but axially rigid connection between nut 16 and runner 17 in FIG. 1, corresponding parts having the same reference numerals but being provided with prime (') and bis (") marks, respectively.

Figure 4:
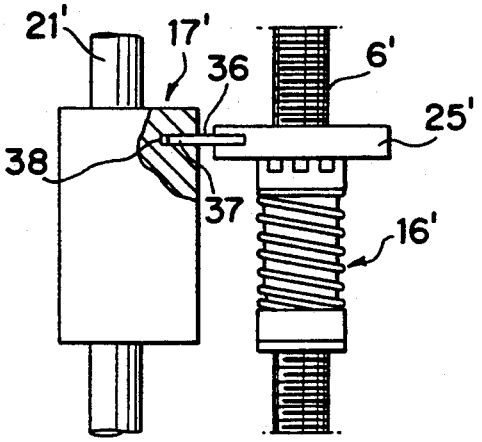
FIG. 4 is a schematic elevational view, partially in section, of another embodiment of radially movable connection between nut portion and plunger supporting part of the runner means.
Figure 5:
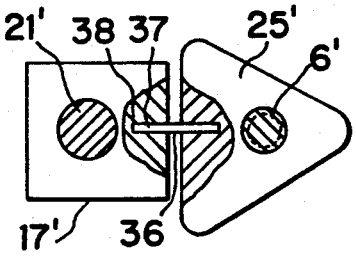
FIG. 5 is a top view, partially in section, of the embodiment in FIG. 4.

In FIGS. 4 and 5 the runner 17' is connected to the nut 16' on drive screw 6' through a horizontally projecting guide pin 36 fixed in a corresponding bore in the top portion 25 of nut 16'. The free end of guide pin 36 extends into an aligned bore 37 in runner 17' of sufficient depth to slidably receive guide pin 36. While the guide pin 36 is not movable in the bore 37 in the axial direction of screw 6' and therefore ensures axial stiffness in the connection, the gap 38 between the pin end and the bottom of bore 37, in combination with the rotatory mounting of runner 17' on rod 21', permits sufficient radial movability of nut 16' to ensure self-centering thereof on screw 6'. It is to be noted, however, that this embodiment, due to the utilization of rotation of runner 17' on rod 21', requires a slight radial movability of piston rod 14 in the syringe cylinder 13 in FIG. 1.

Figure 6:
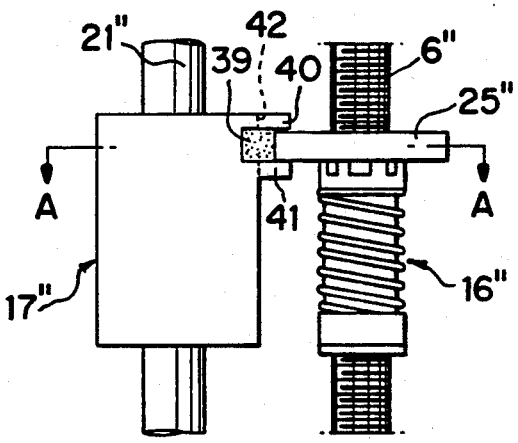
FIG. 6 is a schematic elevational view, partially in section, of still another embodiment of radially movable connection between nut portion and plunger supporting part of the runner means.
Figure 7:
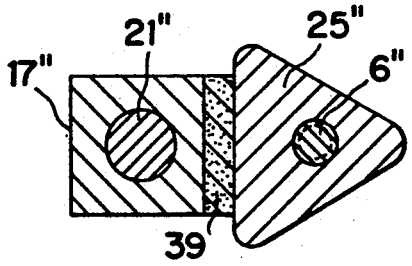
FIG. 7 is a sectional view along A—A in FIG. 6.

In FIGS. 6 and 7 the runner 17" is connected to the nut 16" through an elongate elastic material member 39, e.g. of rubber, disposed inside a horizontal recess 40 provided in a protrusion 41 on one side of runner 17", which recess 40 has a corresponding height as the thickness of the nut top plate 25" for the edge portion of the latter to be slidably accomodated therein. It is not necessary that the elastic member 39 be fixed to the respective runner and nut portions, but in practice the elastic member is suitably fixed in recess 40. Radial movability and rotatory restriction of nut 16" relatively to runner 17" is ensured by the elastic member 39, whereas axial movements of nut 16" in relation to runner 17" are prevented by the upper and lower walls of recess 40 straddling the top plate 25" of nut 16".

In a variation of the embodiment of FIGS. 6 and 7 the protrusion 41 with recess 40 is omitted, as indicated by dashed line 42. In this case the elastic member 39 is fixed to both the runner and the nut and is made of a material which is substantially stiff in the axial direction of screw 6" but resilient in the radial direction.

The invention is, of course, not restricted to the embodiment specifically described above and illustrated in the drawings, but many variations and modifications are possible within the scope of the general inventive concept as defined in the subsequent claims.

I claim:

1. A pump and metering apparatus, comprising a frame (1) supporting a liquid container (13) with a movable plunger therein for discharging respectively drawing in liquid, said plunger being connected to a runner means (17), which by a nut portion (16) thereof threadedly engages a screw (6) rotatably mounted in the frame (1) and coupled to a driving motor (5), characterized in that said nut portion (16) of the runner means (17) is movable in relation to the remaining structure of the runner means (17) in the radial direction of the screw (6) for the nut portion (16) to be self-centering on the centre axis of the screw (6).

2. The apparatus according to claim 1 characterized in that it comprises guide means (21) fixedly arranged in the frame (1) for linear guidance of the runner means (17) in parallel with the screw (6).

3. The apparatus according to claim 1, characterized in that said liquid container (13) is removably attached to the runner means (17).

4. The apparatus according to claim 1, characterized in that the nut portion (16) is of the backlash-free type comprising two nut halves (22, 23) biased away from each other against the thread flank of the screw (6) by means of an intermediate rigid or elastic spacer member.

5. The apparatus according to claim 1, characterized in that the driving motor (5) is a stepping motor.

6. The apparatus according to claim 1, characterized in that said runner means (17) comprise a first separate part forming said nut portion (16), a second separate part connected to the plunger (14), and coupling means (25, 26–33; 36; 37; 39) connecting said first and second parts in a fixed relationship with regard to the axial direction of the screw (6) and in a movable but rotatorily restricted relationship with regard to the radial direction of the screw (6).

7. The apparatus according to claim 6, characterized in that said coupling means comprise at least one rigid member (36), which extends in a radial plane from one of said first and second parts (16, 17) into an aligned radial recess (37) of the other, each said recess (37) being deeper than the extension of the respective rigid member (36) to permit said radial movability of the nut portion in relation to the runner means.

8. The apparatus according to claim 6, characterized in that said connecting means comprise an elastic member (39) permitting said radial movability in combination with guide means (40, 41) preventing relative movability between said first and second parts (16, 17) in the axial direction of the screw (6").

9. The apparatus according to claim 6, characterized in that said coupling means comprise an elastic member (39) fixed to said first and second parts (16, 17) and which is elastic in the radial direction of the screw (6") but at least substantially non-elastic in the axial direction of the screw.

10. The apparatus according to claim 6, characterized in that said first and second parts comprise radially overlapping portions (25, 26) slidably biased against each other by biasing means (34).

11. The apparatus according to claim 10, characterized in that said biasing means are spring means (34) acting between said connection means (30) and either said first (16) or second (17) parts.

12. The apparatus according to claim 10, characterized in that at least one of the contact surfaces of said overlapping parts (25, 26) comprises low friction material.

13. The apparatus according to claim 10, characterized in that a low friction material member (35) is inserted between the opposed surfaces of said overlapping parts (25, 26).

14. The apparatus according to claim 10, characterized in that one of said overlapping portions (25, 26) comprises integral or radially fixed axial connecting means (30) which extend into aligned bores (29) in the other, said bores (29) having a larger diameter than the connecting means (30).

15. The apparatus according to claim 14, characterized in that said bores (29) are provided in said first part (16).

16. The apparatus according to claim 14, characterized in that elastic means (31) are arranged in the interspace between the axial connecting means (30) and the wall surface of the nut bores (29).

17. The apparatus according to claim 14, characterized in that said connecting means are rods (30) extending through aligned axial bores (28, 29) in said first and second parts (25, 26), the bores (28) in one of said parts having the same diameter as the rods (30) and the bores (29) in the other part having a larger diameter than the rods (30).

* * * * *

UNITED STATES PATENT AND TRADEMARK OFFICE

CERTIFICATE OF CORRECTION

PATENT NO. : 5,201,851

DATED : April 13, 1993

INVENTOR(S) : Torbjörn Holmström

It is certified that error appears in the above-identified patent and that said Letters Patent is hereby corrected as shown below:

On the Title Page, [57] ABSTRACT line 3, delete "respectively"

line 4, change "A" to -- The -- line 5, change "connected" to -- which -- and after "thereof" delete "which"

line 6, delete "threadedly"

Signed and Sealed this

Nineteenth Day of April, 1994

*Attest:*

*Attesting Officer*

BRUCE LEHMAN

*Commissioner of Patents and Trademarks*